United States Patent [19]

Stern et al.

[11] Patent Number: 4,777,454

[45] Date of Patent: Oct. 11, 1988

[54] SWITCHABLE DIELECTRIC WAVEGUIDE CIRCULATOR

[75] Inventors: Richard A. Stern, Allenwood; Richard W. Babbitt, Fairhaven, both of N.J.

[73] Assignee: The United States of America as represented by the Secretary of the Army, Washington, D.C.

[21] Appl. No.: 70,755

[22] Filed: Jul. 6, 1987

[51] Int. Cl.[4] ..... H01P 1/383

[52] U.S. Cl. ..... 333/1.1; 333/24.1

[58] Field of Search ..... 333/1.1, 24.1, 24.2

[56] References Cited

U.S. PATENT DOCUMENTS

| | | | |
|---|---|---|---|
| 3,341,789 | 9/1967 | Goodman et al. | 333/1.1 |
| 3,350,663 | 10/1967 | Siekanowicz et al. | 333/1.1 |
| 4,415,871 | 11/1983 | Stern et al. | 333/1.1 |

OTHER PUBLICATIONS

"Use of Ferrimagnetic Material in Circulators", No. 6511 Microwave Ferrite Applications, Trans.-Tech. Inc., Gaithersburg, Md.

*Primary Examiner*—Paul Gensler

*Attorney, Agent, or Firm*—Sheldon Kanars; Robert A. Maikis

[57] ABSTRACT

A switchable dielectric waveguide circulator is provided for millimeter wave frequency applications comprising a ferrite right prism having two polygonal prism bases and at least three lateral prism faces. A control wire is threaded through a number of bores formed in the prism in a plane between the bases. Each of the bores is spaced a distance from a different one of the apices of the prism so that a control current passing through the control wire creates a circular magnetic field about each bore which combine to form a resultant magnetic field between the prism bases which cause the prism faces to act as circulator ports. The rotational direction of circulator coupling action is reversed by reversing the direction of the control current. Both Y-junction and T-junction circulator configurations are shown.

6 Claims, 2 Drawing Sheets

SWITCHABLE DIELECTRIC WAVEGUIDE CIRCULATOR

STATEMENT OF GOVERNMENT RIGHTS

The invention described herein may be manufactured, used and licensed by or for the Government for governmental purposes without the payment to us of any royalties thereon.

BACKGROUND OF THE INVENTION

1. Field of the Invention

This invention relates to dielectric waveguide transmission line components for millimeter wave applications and more particularly to a switchable dielectric waveguide circulator for such applications.

2. Description of the Prior Art

A problem frequently encountered in millimeter wave frequency applications which utilize dielectric waveguide transmission line components is the switching of the millimeter wave frequency signals involved. Because of the extremely small physical size of the dielectric waveguide components used in this region of the frequency spectrum, the switching function should be accomplished by a device of small physical size and which preferably consumes very little energy to accomplish the switching function. Furthermore, the design of the switching device should be as simple as possible to facilitate manufacturing of the device and to keep the manufacturing costs as low as possible. Since switches are often called upon to perform modulation functions, a suitable switching device for applications of this type should also be capable of functioning as a modulator.

Although circulators have been developed for dielectric waveguide components used in millimeter wave frequency applications, they are not usable as switching devices because the circulators themselves are not switchable. For a circulator to be switchable, the rotational direction of circulator coupling action must be easily reversed so that a signal applied to one port of the circulator may be switched to either of the adjacent circulator ports. U.S. Pat. No. 4,415,871, which was issued Nov. 15, 1983 to the applicants of the present application and which was assigned to the same assignee as the present application, shows a dielectric waveguide circulator comprising a right prism-shaped ferrite element which is magnetically biased to provide the circulator action. The magnetic biasing field which must be a unidirectional or "dc" magnetic field is applied to the bases of the prism by permanent magnets. For this circulator to be made switchable, the direction of the applied dc magnetic field must be easily reversed which, of course, is not feasible with the permanent magnet arrangement shown. Although a helically-wound coil, for example, could be utilized to produce the required unidirectional magnetic field, such a coil would require a yoke or other pole structure which would increase the size and weight of the circulator to the point where its use would no longer be desirable in millimeter wave applications where the aforementioned size and weight limitations become of critical importance. Similarly, the conventional dielectric waveguide modulators in use at the present time require wire coil arrangements which again limit their usefulness for applications in the millimeter wave frequency area of the frequency spectrum.

SUMMARY OF THE INVENTION

It is an object of this invention to provide a switchable dielectric waveguide circulator which is suitable for use in the millimeter wave frequency region of the frequency spectrum.

It is a further object of this invention to provide a switchable dielectric waveguide circulator which is of small physical size and low weight.

It is a still further object of this invention to provide a switchable dielectric waveguide circulator of relatively simple design which is easily and inexpensively manufactured.

It is another object of this invention to provide a switchable dielectric waveguide circulator which utilizes only a very small amount of energy to perform the switching function.

It is an additional object of this invention to provide a switchable dielectric waveguide circulator which can be employed as a modulator in millimeter wave applications.

Briefly, the switchable dielectric waveguide circulator of the invention comprises a ferrite right prism having a plurality of mutually parallel apices and a central axis parallel to and spaced equidistant from the apices. The prism has a plurality of lateral prism faces of equal size and rectangular shape extending between the apices and two oppositely-disposed prism bases of equal size and polygonal shape disposed substantially perpendicular to the central axis. The prism also has a plurality of bores therein substantially disposed in a plane intermediate the prism bases. Each of the bores communicates with two adjacent prism faces of the plurality of prism faces and is associated with and spaced a distance from a different apex of the plurality of apices. Finally, means are provided for carrying an electric control current through each of the bores to create a circular magnetic field about the longitudinal axis of each of the bores and a resultant magnetic field comprising the sum of the circular magnetic fields between the prism bases, so that each of the prism faces is adapted to act as a circulator port and the rotational direction of circulator coupling action about the prism central axis can be controlled by controlling the control current. The electric control current carrying means may conveniently comprise electrically conductive wire means threaded through each of the bores such as a single turn of wire, for example.

The nature of the invention and other objects and additional advantages thereof will be more readily understood by those skilled in the art after consideration of the following detailed description taken in conjunction with the accompanying drawings.

DESCRIPTION OF THE PREFERRED EMBODIMENT OF THE INVENTION

Figure 1:
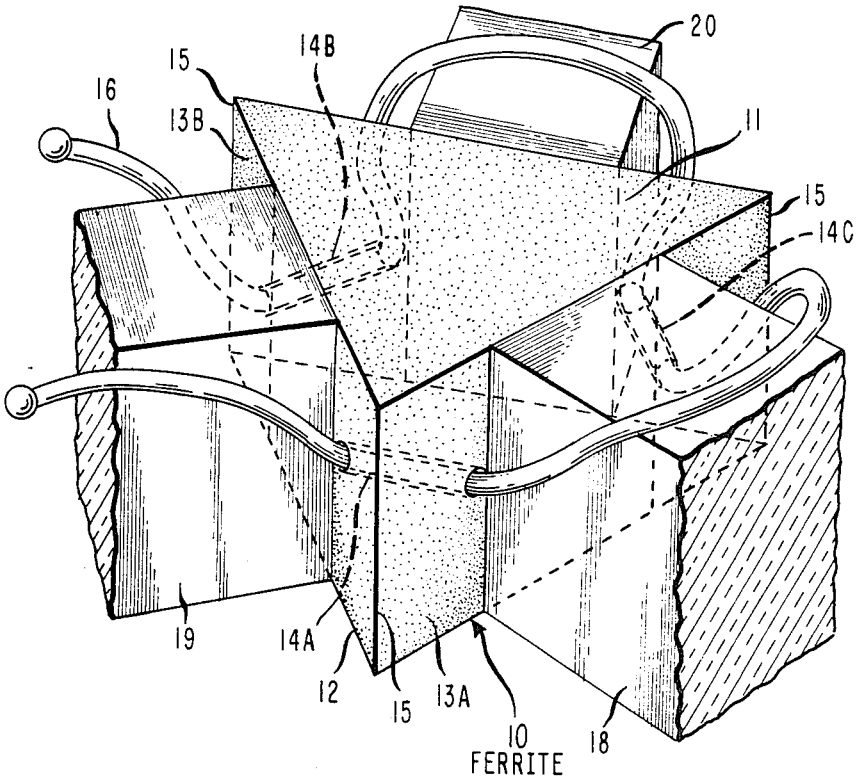
FIG. 1 is a perspective view of a switchable dielectric waveguide circulator constructed in accordance with the teachings of the present invention, the circulator illustrated being a Y-junction circulator.
Figure 2:
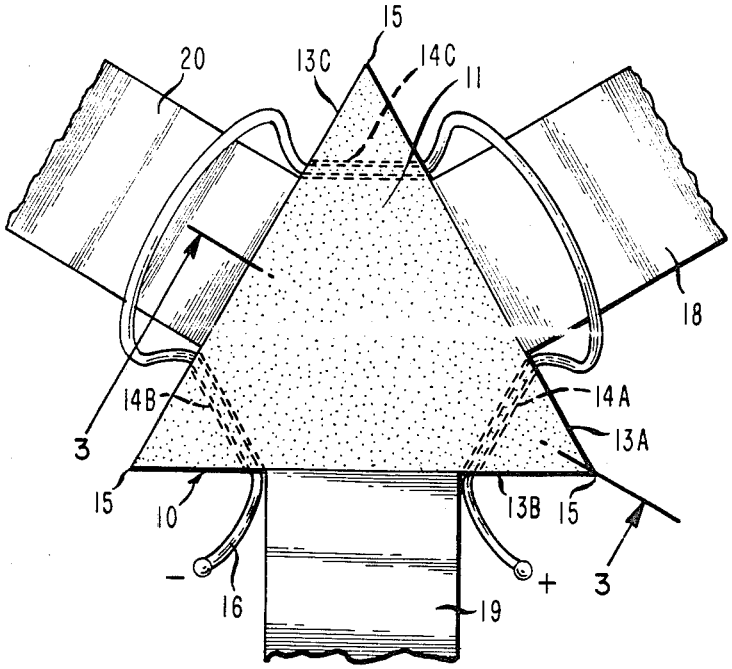
FIG. 2 is a top plan view of the circulator of FIG. 1.
Figure 3:
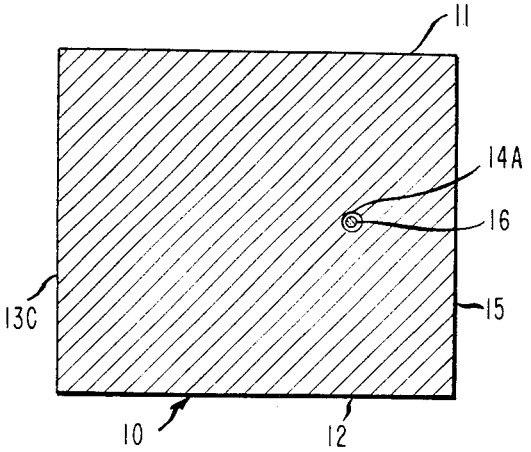
FIG. 3 is a full sectional view of the circulator of FIG. 1 taken along the line 3—3 of FIG. 2 of the drawings.

Referring now to FIGS. 1–3 of the drawings, there is shown a switchable dielectric waveguide circulator constructed in accordance with the teachings of the present invention comprising a ferrite right prism, indicated generally as 10, having a top prism base 11 and a bottom prism base 12 of equal size and polygonal shape and a plurality of lateral prism faces 13A, 13B and 13C of equal size and rectangular shape. The prism is provided with a plurality of bores 14A, 14B and 14C which are substantially disposed in a plane which is intermediate the prism bases 11 and 12. The three apices or corners 15 of the prism 10 are parallel to each other and are also parallel to and spaced equidistant from the central axis of the prism (not shown) which would be perpendicular to the plane of the paper in the view of FIG. 2 of the drawings. Since the prism 10 is a right prism, the two oppositely-disposed prism bases 11 and 12 are substantially perpendicular to the prism central axis and the lateral prism faces 13 extend between the apices 15. Each of the bores 14 communicates with two adjacent prism faces 13 and is associated with and spaced a distance from a different apex of the plurality of apices 15 for reasons which will be explained hereinafter. For example, the bore 14A communicates with the two adjacent prism faces 13A and 13B and is associated with one of the three apices 15 while bore 14B communicates with prism faces 13B and 13C and is associated with a different one of the three apices. Finally, electric control current carrying means such as the single turn of electrically conductive wire 16 illustrated is threaded through each of the bores in the same rotational direction about the central axis of the prism.

Figure 4:
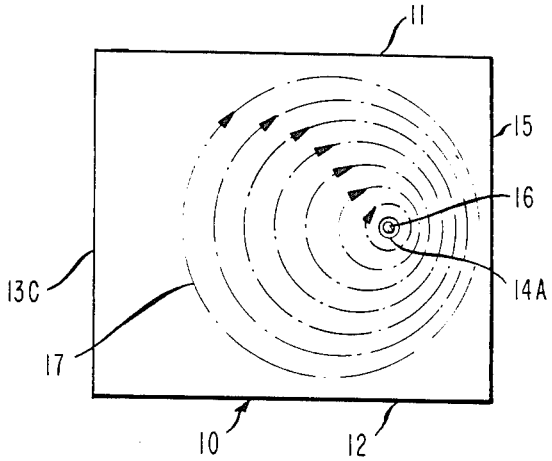
FIG. 4 shows the circular magnetic field created about the bore which is shown in the full-sectional of FIG. 3.

In operation, if a dc current is passed through the control current wire 16, a circular magnetic field will be created about the longitudinal axis of each of the bores 14 because the material of the ferrite prism forms a closed toroidal flux path about the longitudinal axis of each bore. For example, FIG. 3 of the drawings shows the closed toroidal flux path created about the bore 14A and FIG. 4 shows the circular magnetic field, indicated schematically as 17, which is created about the longitudinal axis of bore 14A if a dc voltage having the polarity shown in FIG. 2 of the drawings is applied to the terminals of wire 16. Since the wire 16 passes through each of the bores 14 in the same rotational direction about the prism central axis, i.e., starting from one of the terminals of wire 16 it continues always in the same rotational direction about the prism central axis until it reaches the other terminal of the wire, the circular magnetic fields existing about each of the bores 14 will be added together or summed in the central portion of the prism 10 to create a resultant magnetic field (not shown) between the two prism bases 11 and 12. This resultant magnetic field would be a dc magnetic field which could be represented schematically by an arrow aligned with the central axis of the prism. The direction or polarity of the resultant magnetic field would, of course, depend upon the polarity of the dc voltage applied to the terminals of wire 16. As explained in said U.S. Pat. No. 4,415,871, if a dc magnetic field is applied between the bases of a prism-shaped element which is fabricated of a ferrite material exhibiting gyromagnetic properties, such as nickel zinc ferrite or lithium zinc ferrite, for example, the lateral faces of the prism will act as the ports of a circulator with respect to electromagnetic wave energy applied thereto. Accordingly, a section 18 of dielectric waveguide transmission line having a rectangular cross-sectional area is bonded to that portion of the prism face 13A of prism 10 which lies between the openings for bores 14A and 14C as shown in FIGS. 1 and 2 of the drawings. A similar section of transmission line 19 is bonded to a portion of prism face 13B which lies between the openings for bores 14A and 14B and a similar section 20 of waveguide is bonded to prism face 13C between the openings for bores 14B and 14C. As is known in the art, the sections 18–20 of dielectric waveguide transmission line should be fabricated of a low loss dielectric material which has a dielectric constant which substantially matches the dielectric constant of the ferrite material of the circulator, such as magnesium titanate, for example. With the foregoing arrangement, if a millimeter wave signal, for example, is applied to waveguide section 18 which is bonded to prism face 13A and if the direction of the resultant magnetic field created by the control current in wire 16 is such as to give the circulator a clockwise circulator coupling action, the signal will be coupled to waveguide section 19 and decoupled from waveguide section 20. If the direction of the control current in control wire 16 is reversed, the direction of the resultant magnetic field will be reversed to thereby create a counterclockwise circulator coupling action which will cause the signal applied to waveguide section 18 to be coupled to waveguide section 20 and decoupled from waveguide section 19. It is therefor seen that the rotational direction of circulator coupling action may be easily reversed by reversing the polarity of the control current in control wire 16 so that the switchable circulator of the invention may be easily employed as a switch or a modulator in dielectric waveguide transmission line applications.

In order to minimize the electrical energy required to switch the circulator of the invention, the resultant magnetic field produced by the electric control current should be as large as possible for the smallest amount of control current. To accomplish this, the reluctance of the toroidal flux path around the longitudinal axis of each of the bores 14 should be made as small as possible since this will maximize the resultant magnetic field produced by a given amount of control current. Accordingly, the plane in which all of the bores 14 are disposed should be approximately equidistant between the prism bases 11 and 12 and the distance between a bore and the apex 15 of the prism with which the bore is associated should be such that the sum of the cross-sectional areas of those portions of the prism in the plane in which the bores lie which are bounded by the bores and the two adjacent prism faces is substantially equal to the cross-sectional area of the remaining portion of the prism in the plane in which the bores lie. For example, looking at FIG. 2 of the drawings, it will be seen that each of the three bores 14 forms a triangular-shaped area with the two adjacent prism faces forming the apex 15 with which that bore is accociated. The sum of these three triangular-shaped areas should be substantially equal to the remaining portion of the cross-sectional area of the prism in the plane in which all three bores lie. Since this will, of necessity, involve moving the bores away from each of the apices towards the geometric center of the prism, it is apparent that the space between the bore openings in each of the three prism faces will be reduced so that the cross-sectional area of the waveguide sections 18, 19 and 20 which are bonded to these prism faces must be correspondingly reduced. Accordingly, there is a trade off between maximum flux production and the overall size of the prism which must be employed to accommodate sections of waveguide having a particular crosssectional area. It may also be pointed out that if the ferrite prism 10 is fabricated of a ferrite material having a square hysteresis loop, such as the aforementioned nickel zinc ferrite or lithium zinc ferrite, for example, the ferrite prism 10 may be latched into either of two magnetic states having opposite directions of resultant magnetic field by the application of a small pulse of dc control current. Accordingly, by applying the control current pulse of one polarity the ferrite prism will be latched into one magnetic state in which it will remain until a second control current pulse of opposite polarity is applied to latch the ferrite prism into its other magnetic state. This would eliminate the use of holding electric control currents to keep the circulator in a particular or chosen rotational direction of circulator coupling action and would minimize the amount of control current energy required to accomplish the switching function.

Figure 5:
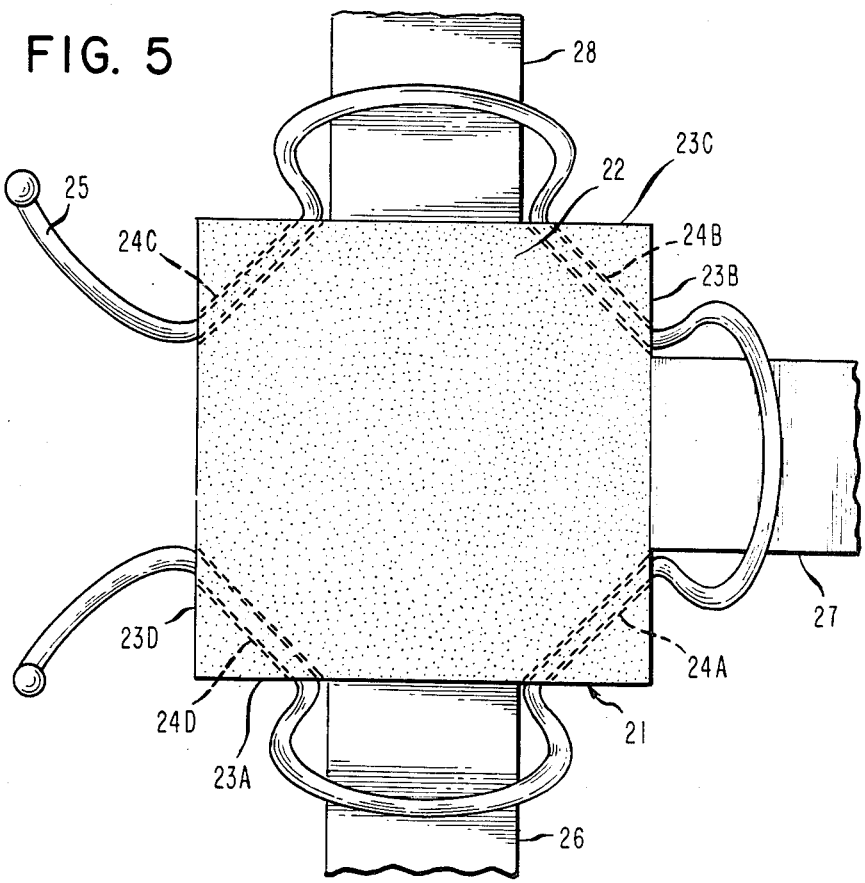
FIG. 5 is a top plan view of a switchable dielectric waveguide circulator of the invention in a T-junction circulator configuration.

In the embodiment of the invention shown in FIGS. 1–4 of the drawings, the two polygonal bases 11 and 12 of the prism are equilateral triangular-shaped so that there are three lateral prism faces 13A, 13B and 13C and the three prism faces are oriented at an angle of 60 degrees with respect to each other which permits the circulator to function as a Y-junction circulator. FIG. 5 of the drawings shows an embodiment of the invention wherein the circulator functions as a switchable T-junction circulator. In this embodiment, a ferrite right prism, indicated generally as 21, has two polygonal prism bases 22 which are square-shaped so that there are four lateral prism faces 23A, 23B, 23C and 23D extending between the mutually parallel apices or corners of the prism. Again, the bases 22 would be of equal size and would be perpendicular to the central axis of the prism which in the view of FIG. 5 would extend normal to the plane of the paper and be located at the geometric center of the square bases. Similarly, the four prism faces 23 would be of equal size and rectangular shape. The prism 21 is provided with four bores 24A, 24B, 24C and 24D which are located in the same manner as the bores of the prism shown in the embodiment of FIGS. 1–4. A control current wire 25 is again threaded through each of the bores 24 to control the switching of the circulator. Since this is a T-junction circulator, dielectric waveguide sections 26, 27 and 28 are bonded to only three of the four lateral faces 23 of the ferrite prism 21. The switchable T-junction circulator described operates in the same manner as the Y-junction circulator of FIGS. 1–4 but since it lacks symmetry around its center so that the characteristics of the three circulator ports are not the same it may not be suitable for use in all applications.

It is believed apparent that many changes could be made in the construction and described uses of the foregoing switchable dielectric waveguide circulator and many seemingly different embodiments of the invention could be constructed without departing from the scope thereof. Accordingly, it is intended that all matter contained in the above description or shown in the accompanying drawings shall be interpreted as illustrative and not in a limiting sense.

What is claimed is:

1. A switchable dielectric waveguide circulator comprising a ferrite right prism having a plurality of mutually parallel apices and a central axis parallel to and spaced equidistant from said apices, a plurality of lateral prism faces of equal size and rectangular shape extending between said apices, two oppositely-disposed prism bases of equal size and polygonal shape disposed substantially perpendicular to said central axis, and a number of bores therein equal to the number of said prism faces and substantially disposed in a plane which is equidistant between said prism bases, each of said bores communicating with two adjacent prism faces of said plurality of prism faces and being associated with and spaced a distance from a different apex of said plurality of apices, said distance being such that the sum of the cross-sectional areas of those portions of said prism in said plane which are bounded by said bores and said two adjacent prism faces is substantially equal to the cross-sectional area of the remaining portion of said prism in said plane;

a plurality of dielectric waveguide transmission lines, each of said transmission lines having one end thereof coupled to a different one of said plurality of prism faces between the bores in said one prism face; and means for carrying an electric control current through each of said bores to create a circular magnetic field about the longitudinal axis of each of said bores and a resultant magnetic field comprising the sum of said circular magnetic fields between said prism bases, so that the reluctance of the flux path of said circular magnetic field about each of said bores is minimized and said resultant magnetic field is maximized whereby each of said prism faces acts as a circulator port and the rotational direction of circulator coupling action about said prism central axis is controlled by controlling said control current.

2. A switchable dielectric waveguide circulator as claimed in claim 1 wherein said electric control current carrying means comprises electrically conductive wire means threaded through each of said bores.

3. A switchable dielectric waveguide circulator as claimed in claim 2 wherein said electrically conductive wire means comprises a single turn of wire passing through each of said bores in the same rotational direction about said prism central axis.

4. A switchable dielectric waveguide circulator as claimed in claim 2 wherein said prism bases are equilateral triangular-shaped so that there are three of said prism faces, whereby said circulator functions as a Y-junction circulator.

5. A switchable dielectric waveguide circulator as claimed in claim 2 wherein said prism bases are square-shaped so that there are four of said prism faces, whereby said circulator functions as a T-junction circulator.

6. A switchable dielectric waveguide circulator as claimed in claim 3 wherein said ferrite right prism is fabricated of a ferrite material having a square hysteresis loop so that the poloarity of said resultant magnetic field may be latched from one state to the opposite state by the application of a control current pulse to said single turn of wire.

* * * * *